United States Patent [19]

Patton et al.

[11] Patent Number: 5,006,125

[45] Date of Patent: Apr. 9, 1991

[54] PROCESS FOR IMPROVING THE DYEABILITY AND WHITENESS OF CELLULOSIC FABRICS

[75] Inventors: Robert T. Patton; John D. Kitchens, both of Lake Jackson, Tex.; David M. Hall, Auburn, Ala.

[73] Assignee: The Dow Chemical Company, Midland, Mich.

[21] Appl. No.: 432,954

[22] Filed: Nov. 7, 1989

Related U.S. Application Data

[63] Continuation-in-part of Ser. No. 243,575, Sep. 13, 1988, abandoned.

[51] Int. Cl.[5] ..... D06M 13/322

[52] U.S. Cl. ..... 8/188; 8/110; 8/111; 8/116.1; 8/181

[58] Field of Search ..... 8/188, 110, 111, 181, 8/116.1

[56] References Cited

U.S. PATENT DOCUMENTS 3,685,953 8/1972 Cuvelier et al. ..... 8/115

*Primary Examiner*—Prince E. Willis
*Assistant Examiner*—John F. McNally

[57] ABSTRACT

In a process for treating a cellulosic fabric which includes the step of scouring and/or bleaching the improvement which comprises treating said fabric with a quaternary compound of the formula selected from the group consisting of:

and wherein R, R′, R″ and R‴ are each lower alkyl radicals and $X^-$ is an anion prior to dyeing so as to improve its whiteness and/or dyeability.

9 Claims, 1 Drawing Sheet

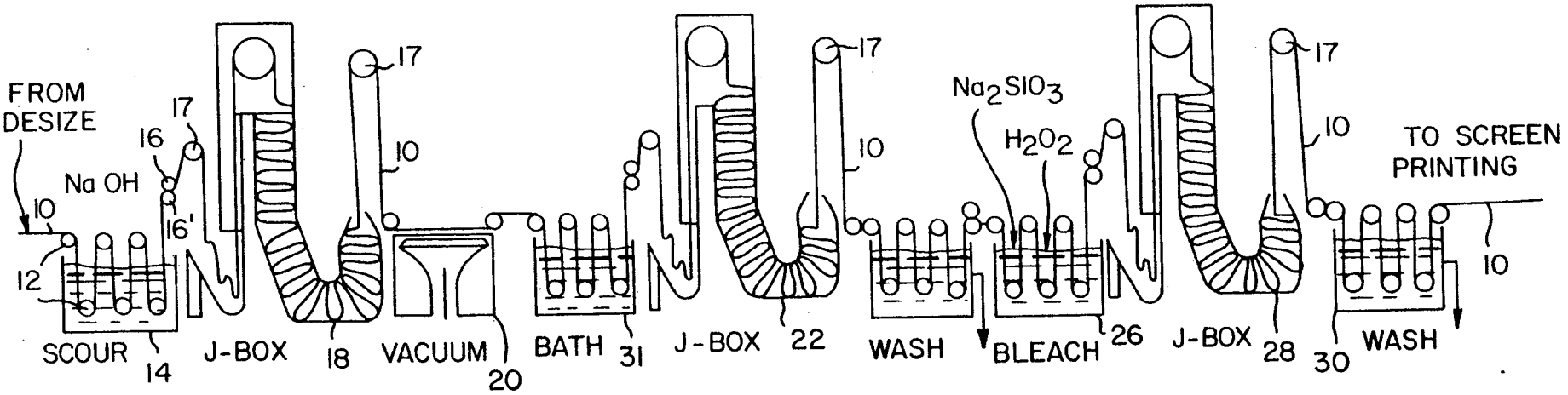
FROM DESIZE
10
Na OH
12
SCOUR
14
16
16'
17
J-BOX
18
10
17
VACUUM
20
BATH
31
J-BOX
22
10
17
WASH
$Na_2SiO_3$
$H_2O_2$
BLEACH
26
J-BOX
28
10
17
WASH
30
TO SCREEN PRINTING
10

PROCESS FOR IMPROVING THE DYEABILITY AND WHITENESS OF CELLULOSIC FABRICS

RELATED APPLICATIONS

This application is a continuation-in-part of application Ser. No. 243,575, filed Sept. 13, 1988, now abandoned.

FIELD OF THE INVENTION

The present invention relates to a process and composition for improving the printability, dyeability and/or whiteness of cellulosic fabrics. More particularly, the invention relates to a process for improving the whiteness and/or dyeing characteristics of cellulosic fibers and/or fabrics through the use of a chlorohydroxylalkyltrialkyl ammonium salt or an epoxy lower alkyl ammonium salt alone or in combination with sodium sulfate.

BACKGROUND OF THE INVENTION

Cellulosic textiles, prior to dyeing or printing in commercial operations, usually undergo treatment with caustic to remove fats, oils or other materials. The process is called "scouring" and is generally performed with a solution of caustic soda at elevated temperatures. Following the scouring process, the fabric is subjected to steaming.

To improve the whiteness of the fabrics, the fabrics are usually subjected to a bleaching step with a peroxide solution. Following bleaching, the fabrics are also subjected to steaming, washing and drying.

However, there are fabric treating operations which do not employ caustic scouring baths. In place of scouring a two step bleaching operation is commonly utilized.

It is known to treat cotton with quaternary salts to improve its dyeability. Choline chloride has been utilized but it has the drawback of being sensitive to changes in curing temperature.

The presence of the quaternary compound in the bleach bath results in a greater uptake of any anionic fabric brightener.

U.S. Pat. No. 3,685,953 to Cavelier et al, which is herein incorporated by reference, discloses the utilization of an epoxypropyl ammonium salt with a strong mineral base as a fixation catalyst during scouring in order to improve the dyeability of cellulosic fibers. The epoxypropyl ammonium salt is used with at least 0.5% of the base as a catalyst to cause fixation of the epoxypropyl ammonium salt.

The measurement of colors in the present application is pursuant to the Adams-Nickerson or AN/AB space known as CIELAB. In this color space, "a" represents red/green, "+a" being red, "−a" being green, "b" represents yellow/blue, "+b" being yellow, "−b" being blue.

The term "fabric" as used herein is intended to include textile materials such as filaments, yarns, tows, battings, woven and non-woven cloth, knitted fabric and the like.

SUMMARY OF THE INVENTION

The present invention relates to an improvement in the process of treating cellulosic fabrics so as to improve their whiteness and/or their dyeability or printability. More particularly, the invention is concerned with the treatment of a cellulosic fabric in a process which includes the steps of scouring and/or bleaching with a quaternary compound of the formula selected from the group consisting of:

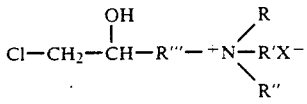

and

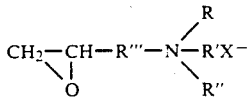

wherein R, R,' R'' and R''' are each lower alkyl radicals and X is an anion, subsequent to scouring. Preferably, the compounds are chlorohydroxypropyltrimethylammonium chloride or epoxypropyl trimethylammonium chloride. The quaternary compound is utilized in an aqueous solution in an amount of about 0.1 to 15% by weight of solution, preferably, about 0.5–2.0%.

The chlorohydroxy alkyl trialkyl ammonium salt is utilized in processes which do not utilize a scouring bath, that is, only within a bleach bath.

The sodium sulfate is believed to enhance reactivity with available alcoholates, which are produced in the scouring step. It has been found that the use of the quaternary compound in the bleaching step improves the dyeability of the fabric. This treatment of the fabric has been found to produce leveling of pigment in the printing process and to reduce the pigment requirement in some cases as much as 20%. Generally, there was found to be an improvement in printing and dyeing with anionic dyes and pigments.

The present invention can be utilized with all cellulosic materials such as cotton, linen, flax, viscose, and the like. Cotton fabrics with enhanced durability press properties derived from treatment with crosslinking resins have also been improved in their dyeability with the process of the invention.

It is therefore an object of the present invention to improve the dyeability of cellulosic materials through the use of chlorohydroxyalkyltrialkylammonium salt or its epoxy form.

It is another object of the invention to provide a means for reducing the amount of pigment required in the printing of cellulosic fabrics.

It is a further object of the invention to improve uniformity in dyeing of cellulosic materials.

It is a yet still further object of the invention to improve the reactivity of chlorohydroxyalkyltrialkylammonium salts or epoxy lower alkyl ammonium salts with cellulosic fabrics.

Other objects and a fuller understanding of the invention will be had by referring to the following description and claims of preferred embodiments, taken in conjunction with the accompanying drawing.

BRIEF DESCRIPTION OF THE DRAWING

The drawing is a schematic representation of the treatment of cellulosic fibers prior to dyeing including a fabric treatment section according to the invention.

DESCRIPTION OF THE PREFERRED EMBODIMENT

Although specific terms are used in the following description for the sake of clarity, these terms are intended to refer only to the particular structure selected for illustration in the drawing, and are not intended to define or limit the scope of the invention.

The drawing schematically represents a typical fabric treatment process with several treatment areas which includes the various embodiments of the present invention so as to result in a cellulosic fabric of improved whiteness and/or improved dyeing characteristics. As shown, a cellulosic fabric 10 is preferably passed in countercurrent flow through a scouring bath 14 by means of rolls 12 in a continuous process. However, the process may be carried out step-wise or batchwise depending upon the fabric.

The scouring bath 14, which generally comprises a 2 to 10% solution of sodium hydroxide and about 0.1 to 0.5% detergent, is at ambient to elevated temperature (about 100° C). If desired, epoxypropyl trimethylammonium chloride may optionally be added to the bath according to the process. The scouring process produces alcoholates (for example, sodium alcoholates) in the fabric.

Following the scouring bath, the fabric may be conveyed to a steamer 18 after passage through contact or squeegee rolls 16, 16′ and a conveyor roll 17. The treatment in the steamer 18 is usually for a period of about one half hour. However, in lieu of placing the epoxypropyl trimethylammonium chloride in the scouring bath it may be applied to the fabric prior to steaming.

After the steam treatment the fabric is conveyed from the steamer 18 over a conveyor roll 17 to a vacuum or aspirator means 20 for removal of a substantial portion of any residual sodium hydroxide solution. Also, the fabric may be washed with brine or water to remove alkaline residue from the fabric.

The fabric is then treated with about 0.1 to about 15%, preferably about 0.7–2% on weight fabric of epoxypropyl trimethylammonium chloride. As shown, the fabric 10 preferably passes in countercurrent flow through the bath 31 which contains the epoxypropyl trimethylammonium chloride.

In lieu of bath 31, the fabric may be sprayed or treated with a foam and vacuum process.

Advantageously, the bath also contains sodium sulfate in an amount up to about 35% by weight of solution, preferably, about 25–30% by weight. The presence of the sodium sulfate is believed to aid in the fixation of the epoxypropyl trimethylammonium chloride by increasing the availability of the alcoholate groups of the cellulosic fabric and the epoxy groups for reaction.

It is preferable, but not essential, that the fabric after treatment with epoxypropyl trimethylammonium chloride be steam treated. The steam treatment aids in affixing the epoxypropyl trimethylammonium chloride to the alcoholate groups of the cellulosic fabric 10. In some cases, the fabric is next washed, dried and then treated with an anionic dye without any other treatment steps.

In the procedure illustrated, the fabric 10 proceeds to a bleaching bath 26 wherein it is treated with a bleaching solution. The bleaching solution consists of a solution of hydrogen peroxide or sodium hypochlorite in an amount of about 0.5 to 6.0%, preferably about 0.5 to 2% by weight of solution.

It is understood however, that the employment of the quaternary compound, especially chlorohydroxypropytrimethylammonium chloride is preferably utilized where in lieu of the scouring bath a bleach bath is utilized.

When the bleaching solution comprises hydrogen peroxide, the bleach step is preferably followed by treating with steamer in steamer 28 and then a countercurrent rinsing in a water bath 30 as shown in the drawing. The fabric 10 may then be further processed as required prior to printing or dyeing, for example, aspirating and drying.

It is understood that all percentages as herein utilized are based on weight percentage.

Exemplary of the present invention are set forth in the following examples:

EXAMPLE 1

A. Scouring and Preparation of Alcoholates

A 2″×4″ specimen of cotton twill cloth was immersed in 200 cc of boiling 10% NaOH, removed, passed through a laboratory padder, returned to the boiling NaOH solution and then refluxed for five minutes. The specimen was removed and washed ten times with 500 cc volumes of deionized water. The pH of the water squeezed from the cloth was neutral.

The above procedure was repeated using of 5% solution of LiOH instead of 10% NaOH.

B. Reaction with Epoxypropyl Trimethylammonium Chloride

Epoxypropyl trimethylammonium chloride was prepared by heating 200cc of 4% solution of 3-chloro, 2-hydroxypropyl trimethlyammonium chloride to 50° C. and a stoichiometric quantity of NaOH. 90 g. of $Na_2SO_4$ was added to the solution and the temperature was raised to boiling. Cotton cloth which had been refluxed in alkali metal hydroxide and then washed as described in Part A, was placed in the epoxide solution. The solution was buffered to pH7. The cotton was removed, passed through a laboratory padder, returned to the liquid mixture and then refluxed for one hour. The specimens were then aspirated in a Buchner funnel to remove entrained moisture and placed in an oven at 120° C. for 30 minutes. The samples were then washed ten times with 500 cc volumes of deionized water and analyzed for Nitrogen using an ANTEC TM nitrogen analyzer.

| Specimen | ppm N |
|---|---|
| NaOH alcoholate, washed | 560 |
| LiOH alcoholate, washed | 550 |
| Control (no alcoholate formation) | 220 |

EXAMPLE 2

A specimen of cotton cloth, treated with dimethylol dihydroxyethyleneurea (DMDHEU) crosslinking resin was treated according to the procedure described in Part A of Example 1, and then washed ten times in 500 cc volumes of deionized water. Then the specimen was cationized by reacting it in a bath of 4% epoxypropyl trimethylammonium chloride containing 20 g/100 cc of sodium sulfate. The reaction mixture was buffered to pH 7 and allowed to react for one hour. At the end of one hour, the cloth was removed from the reaction mixture and washed ten times with deionized water.

The specimen was then dyed with Althouse brand Superlitefast TM blue direct dye under the following conditions:

a) 30:1 ratio bath to cloth
b) 2% dye based on wt cloth
c) 100° C. for one hour
d) no salt used Along with the alkali-treated specimen was also dyed a specimen of the identical durable press crosslinked fabric which had not been alkali-treated and washed. After dyeing, the specimens were washed in two liters of deionized water containing 0.5% detergent at 60° C. for one hour. Then the specimens were rinsed with deionized water and dried at room temperature. The dye uptake of the specimens was compared by taking reflectance measurements on the cloth with and without the alkali treatment. A Photovolt model 577 reflectance meter with a blue color filter was used. The lower the reflectance the greater the amount of dye uptake.

| Specimen Description | Reflectance |
|---|---|
| 1. NaOH treatment & deionized water wash followed by treatment with epoxy compound | 7.4 |
| 2. NaOH treatment & deionized water wash followed by boiling twice in deionized water | 32.2 |
| 3. Epoxy compound application without NaOH treatment | 64.2 |
| 4. Control (blank cloth without epoxy compound) | 68.8 |

EXAMPLE 3

The effect of $Na_2SO_4$ on the level of Nitrogen Fixation in the Reaction of Epoxy Compound with Cotton Cloth A. Alkali pre-treatment: two 2"×4" specimens of style #423 cotton twill test fabric were immersed in boiling 5% Lithium Hydroxide. They were removed, passed through a laboratory padder, returned to the LiOH solution and refluxed for 5 minutes. The specimens were then removed, drained on a paper towels and passed through a laboratory padder to remove most of the moisture.

B. A 2% solution of 3-chloro, 2-hydroxypropyl trimethylammonium chloride was brought to 50° C. and stoichiometrically neutralized with NaOH. It was divided into two portions wherein each contained a specimen. To one portion was added an excess of sodium sulfate. The solutions were brought to boiling (107° C. for the solution saturated with sodium sulfate) and allowed to reflux for one hour. The pH of the refluxing solution was 10–11. After one hour the specimens was removed, placed in a beaker of deionized water, neutralized with dilute HCI and then washed ten times with 500 cc volumes of deionized water. The specimens were analyzed for Nitrogen using an ANTEK TM Nitrogen analyzer.

Results:

| Specimen Description | N.ppm |
|---|---|
| 1. Cotton cloth reacted in the absence of $Na_2SO_4$ | 752 |
| 2. Cotton cloth reacted in the system saturated with $Na_2SO_4$ | 1085 |
| 3. Control (untreated cotton cloth) | essentially zero |

EXAMPLE 4

Pairs of enzyme desized and caustic scoured Testfabrics style 428R 100% cotton fabric patches are treated in 2% hydrogen peroxide baths at various pH's stabilized with 0.15% $MgCl_2$ $6H_2O$, 0.25% (solids basic) Primacor 5980® Dow Adhesive Polymer Ethylene/Acrylic Acid Dispersion, 0.2% Synthrapol non-ionic wetting agent, and 0.5% Sorbitol. Each pair of patches is divided into a control and a test patch. Four control patches is are treated in the above described bleach baths which have each been modified by the addition of 0.5% (solids basic) Quat 188- Dow Chemical Company propyl chlorohydrin trimethyl ammonium chloride. The 11.5 inch by 6.75 inch patches are kept damp after the scouring step. Each patch is double dipped and double padded through its bath for an 85% to 90% wet pickup. The sample is sealed in a type 5A Launderometer container and immersed in a boiling water bath for 45 minutes. The bleached patches are washed in two changes of 50 to 1 liquor to goods ratio boiling deionized water and one 100 to 1 ratio cool deionized water wash. The patches are padded to 70% wet pickup and allowed to air dry at room temperature. The samples are then dyed in a beaker containing 1.0% OWG (on weight goods) direct green No. 26 dye at 95 degrees Centigrade and a 10:1 liquor to goods ratio for a duration of 60 minutes. After dyeing, the samples are rinsed in deionized water, air dried, and ironed flat. Color measurements are then made on each sample using a Hunterlab D25 colorimeter at six different points on the sample, taking L, a and b spectrum measurements. Data tabulated on this experiment are shown in Table 1.

TABLE 1

Study of dyeability of 100% cotton printcloth treated with propychlorohydrin trimethylammonium chloride .15% $MgCl_2.6H_2O$, .25% EAA, .2% Synthropol, and .5% sorbitol in the bleach bath them dyed with green direct dye No. 26

| SAMPLE | 2 | 2C | 3 | 3C | 4 | 4C | 6 | 6C |
|---|---|---|---|---|---|---|---|---|
| Percent Wet Pickup | 86.1% | 86.2% | 88.4% | 88.2% | 87.0% | 87.4% | 86.8% | 90.0% |
| Wt % Chptmac OWB | 0.50% | 0.00% | 0.50% | 0.00% | 0.50% | 0.00% | 0.00% | 0.00% |
| Wt % $H_2O_2$ OWB | 1.92% | 1.97% | 1.94% | 2.00% | 1.89% | 1.95% | 2.02% | 1.98% |
| pH | 10.00 | 10.00 | 10.33 | 10.33 | 10.67 | 10.67 | 11.00 | 11.00 |
| Color | | | | | | | | |
| Cielab L | 53.0 | 55.0 | 52.4 | 54.7 | 52.8 | 55.5 | 51.0 | 53.9 |
| Cielab a | −20.6 | −20.1 | −20.6 | −20.2 | −20.3 | −20.1 | −20.8 | −19.9 |
| Cielab b | 1.1 | 1.5 | 1.2 | 1.2 | 1.4 | 1 | 1.5 | 1.1 |

EXAMPLE 5

Following the procedure of Example 4, however, direct blue No. 25 dye is used instead of direct green No. 26. In this experiment, pairs of enzyme desized and caustic scoured Testfabrics style 428R 100% cotton fabric patches are treated in 2% hydrogen peroxide baths at various pH stabilized with 0.15% $MgCl_2.6H_2O$, 0.25% (solids basic) Primacor 5980* Dow Adhesive Polymer Ethylene/Acrylic Acid Dispersion, 0.2% Synthrapol non-ionic wetting agent, and 0.5% Sorbitol. Each pair of patches is divided into a control and a test patch. Four control patches are treated in the above described bleach bath at individual experiment pH's of 10, 1033, 10.67, and 11. Four test patches are treated in the above described bleach baths which have each been modified by the addition of 0.5% (solids basic) Quat 188—Dow Chemical Company propyl chlorohydrin trimethyl ammonium chloride. The 11.5 inch by 6,75 inch patches are kept damp after the scouring step. Each patch is double dipped and double padded through its bath for an 85% to 90% wet pickup. The sample is sealed in a type 5A Launderometer container and immersed in a boiling water bath for 45 minutes. The bleached patches are washed in two changes of 50 to 1 liquor to gods ratio boiling deionized water and one 100 to 1 ratio cool deionized water wash. The patches are padded to 70% wet pickup and allowed to air dry at room temperature. The samples are then dyed in a beaker containing 1.0% OWG (on weight goods) direct blue No. 25 dye at 95 degrees Centigrade and a 10:1 liquor to goods ratio for a duration of 60 minutes. After dyeing, the samples are rinsed in deionized water, air dried, and ironed flat. Color measurements are then made on each sample using a Hunterlab D25 colorimeter at six different points on the sample, taking L, a and b spectrum measurements. Data tabulated on this experiment are shown in Table 2.

EXAMPLE 6

The procedure of Example 4 was followed except that there was used a bleach bath stabilizer system containing less Sorbitol and $MgCl_2$ in solution. In this experiment, pairs of enzyme desized and caustic scoured Testfabrics style 428R 100% cotton fabric patches are treated in 2% hydrogen peroxide baths at various pH's stabilized with 0.075% $MgCl_2.6H_2O$, 0.25% (solids basis) Primacor 5980* Dow Adhesive Polymer Ethylene/Acrylic Acid Dispersion, 0.2% Synthrapol non-ionic wetting agent, and 0.2% Sorbitol. Each pair of patches is divided into a control and a test patch. Four control patches are treated in the above described bleach bath at individual experiment pH's of 10, 10.33, 10.67 and 11. Four test patches are treated in the above described bleach baths which have been modified by the addition of 0.5% (solids basic) Quat 188—Dow Chemical Company propyl chlorohydrin trimethyl ammonium chloride. The 11.5 inch by 6.75 inch patches are kept damp after the scouring step. Each patch is double dipped and double padded through its bath for an 85% to 90% wet pickup. The sample is sealed in a type 5A Launder-ometer container and immersed in a boiling water bath for 45 minutes. The bleached patches are washed in two changes of 50 to 1 liquor to goods ratio boiling deionized water and one 100 to 1 ratio cool deionized water wash. The patches are padded to 70% wet pickup and allowed to air dry at room temperature. The samples are then dyed in a beaker containing 1.0% OWG (on weight goods) direct blue No. 25 dye at 95 degrees Centigrade and a 10:1 liquor to goods ratio for a duration of 60 minutes. After dyeing, the samples are rinsed in deionized water, air dried, and ironed flat. Color measurements are then made on each sample using a Hunterlab D25 colorimeter at six different points on the sample, taking L, a and b spectrum measurements. Data tabulated on this experiment are shown in Table 3.

TABLE 2

Study of dyeability of 100% cotton printcloth treated with propychlorohydrin trimethylammonium chloride 15% $MgCl_2.6H_2O$, .25% EAA, .2% Synthropol, and .5% sorbitol in the bleach bath them dyed with green direct dye No. 25

| SAMPLE | 2 | 2C | 3 | 3C | 4 | 4C | 6 | 6C |
|---|---|---|---|---|---|---|---|---|
| Percent Wet Pickup | 86.1% | 86.2% | 88.4% | 88.2% | 87.0% | 87.4% | 86.8% | 90.0% |
| WT % Chptmac OWB* | 0.50% | 0.00% | 0.50% | 0.00% | 0.50% | 0.00% | 0.50% | 0.00% |
| Wt % $H_2O_2$ OWB | 1.92% | 1.97% | 1.94% | 2.00% | 1.89% | 1.95% | 2.02% | 1.98% |
| pH | 10.00 | 10.00 | 10.33 | 10.33 | 10.67 | 11.00 | 11.00 | 11.00 |
| Color | | | | | | | | |
| Cielab L | 53.4 | 56.2 | 51.8 | 55.2 | 51.8 | 55.3 | 49.4 | 54.1 |
| Cielab a | −0.2 | 0.7 | 1.7 | 1 | 1 | 0.2 | 2.7 | 1.3 |
| Cielab b | −29.8 | −29.8 | −32.1 | −31 | −30.8 | −30.2 | −33.3 | −31.8 |

*On Weight Bath

TABLE 3

Study of dyeability of 100% cotton printcloth treated with propychlorohydrin trimethylammonium chloride .15% $MgCl_2.6H_2O$, .25% EAA, .2% Synthropol, and .5% sorbitol in the bleach bath them dyed with green direct dye No. 25

| SAMPLE | 7 | 7C | 8 | 8C | 10 | 10C | 11 | 11C |
|---|---|---|---|---|---|---|---|---|
| Percent Wet Pickup | 88.3% | 87.3% | 87.6% | 86.9% | 88.3% | 83.0% | 85.0% | 82.8% |
| WT % Chptmac OWB* | 0.50% | 0.00% | 0.50% | 0.00% | 0.50% | 0.00% | 0.50% | 0.00% |
| Wt % $H_2O_2$ OWB | 1.96% | 1.98% | 1.97% | 1.96% | 1.96% | 1.97% | 1.94% | 1.96% |
| pH | 10.00 | 10.00 | 10.33 | 10.33 | 10.67 | 10.67 | 11.00 | 11.00 |
| Color | | | | | | | | |

TABLE 3-continued

Study of dyeability of 100% cotton printcloth treated with propychlorohydrin trimethylammonium chloride .15% $MgCl_2.6H_2O$, .25% EAA, .2% Synthropol, and .5% sorbitol in the bleach bath them dyed with green direct dye No. 25

| SAMPLE | 7 | 7C | 8 | 8C | 10 | 10C | 11 | 11C |
|---|---|---|---|---|---|---|---|---|
| Cielab L | 52.2 | 54.5 | 52.7 | 56.4 | 51.6 | 55.8 | 51.7 | 56.5 |
| Cielab a | −20.4 | −20.1 | −20.2 | −20.0 | −20.6 | −19.9 | −20.5 | −19.7 |
| Cielab b | 1.0 | 1.2 | 1.1 | 1.2 | 1.1 | 1.2 | 1.0 | 1.0 |

*On Weight Bath

EXAMPLE 7

The procedure of Example 4 was followed except that there was used a bleach bath stabilizer system containing less Sorbitol and $MgCl_2$ in solution. In this experiment, pairs of enzyme desized and caustic scoured Testfabrics style 428R 100% cotton fabric patches are treated in 2% hydrogen peroxide baths at various pH's stabilized with 0.075% $MgCl_2.6H_2O$, 0.25% (solids basic) Primacor 5980* Dow Adhesive Polymer Ethylene/Acrylic Acid Dispersion, 0.2% Synthrapol non-ionic wetting agent, and 0.2% Sorbitol. Each pair of patches is divided into a control and a test patch. Four control patches are treated in the above described bleach bath at individual experiment pH's of 10, 10.33, 10.67 and 11. Four test patches are treated in the above described bleach baths which have been modified by the addition of 0.5% (solids basic) Quat 188—Dow Chemical Company propyl chlorohydrin trimethyl ammonium chloride. The 11.5 inch by 6.75 inch patches are kept damp after the scouring step. Each patch is double dipped and double padded through its bath for an 85% to 90% wet pickup. The sample is sealed in a type 5A Launder-ometer container and immersed in a boiling water bath for 45 minutes. The bleached patches are washed in two changes of 50 to 1 liquor to goods ratio boiling deionized water and one 100 to 1 ratio cool deionized water wash. The patches are padded to 70% wet pickup and allowed to air dry at room temperature. The samples are then dyed in a beaker containing 1.0% OWG (on weight goods) direct blue No. 25 dye at 95 degrees Centigrade and a 10:1 liquor to goods ratio for a duration of 60 minutes. After dyeing, the samples are rinsed in deionized water, air dried, and ironed flat. Color measurements are then made on each sample using a Hunterlab D25 colorimeter at six different points on the sample, taking L, a and b spectrum measurements. Data tabulated on this experiment are shown in Table 3.

EXAMPLE 8

This experiment shows that propylchlorohydrin trimethyl ammonium chloride can be incorporated into a hydrogen peroxide bleach bath for the purpose of improving utilization of a fabric brightener also contained in the bleach bath. In this experiment, enzyme desized and 4% OWB caustic scoured Testgabrics style 428R 100% cotton fabric samples are treated in a 2% hydrogen peroxide bath at a pH of 10.8 stabilized with 0.15% Mg $Cl_2$ $6H_2O$. 0.25% (solids basis), Primacor 598® (Dow Adhesive Polymer Ethylene/Acrylic Acid Dispersion), 0.2% Triton non-ionic wetting agent, and 0.2% dodecylbenzenesulfonic acid. All fabric samples measure approximately 10 inch by 7 inch. Caustic scouring is performed with each sample by first padding 4% OWB (on weight bath) caustic, 0.25% sodium laurel sulfate, and other additives required in the individual run on the fabric at an 85% wet pickup. The sample is then sealed in a type 2A launder-ometer container and held at 93 degrees for 30 minutes. The sample is then boiled in 800 mls. deionized water, padded to minimum wet pickup and left wet until bleaching is commenced. Fabric sample No. 1 is prepared in the unaltered bleach bath described above. Fabric sample No. 2 is treated in the previously described bleach bath additionally containing 0.5% OWB Mobay Phor-white BA brightener. Fabric sample No. 3 is treated in the above described bleach bath additionally containing 0.5% OWB Mobay Phor-white brightener. Fabric sample No. 3 is treated in the above described bleach bath additionally containing 0.5% OWB Mobay Phor-white 8a brightener and 1% OWB (solid basis) Dow Chemical Company Quat 188 propyl chlorohydrin trimethyl ammonium chloride. Fabric sample No. 4 is prepared just like sample No. 3 with the exception that 1% Quat 188 OWB is incorporated in the 4% caustic scouring bath. Fabric sample No. 5 is prepared just like sample No. 2 with the exception that 1% Quat 188 OWB is incorporated in the 4% caustic scouring bath. Fabric sample No. 6 is prepared just like sample No. 2 with the exception that 1% Quat

TABLE 4

Study of dyeability of 100% cotton printcloth treated with propychlorohydrin trimethylammonium chloride .15% $MgCl_2.6H_2O$, .25% EAA, .2% Synthropol, and .5% sorbitol in the bleach bath them dyed with green direct dye No. 25

| SAMPLE | 7 | 7C | 8 | 8C | 10 | 10C | 11 | 11C |
|---|---|---|---|---|---|---|---|---|
| Percent Wet Pickup | 88.3% | 87.3% | 87.6% | 86.9% | 88.3% | 83.0% | 85.0% | 82.8% |
| WT % Chptmac OWB* | 0.50% | 0.00% | 0.50% | 0.00% | 0.50% | 0.00% | 0.50% | 0.00% |
| Wt % $H_2O_2$ OWB | 1.96% | 1.98% | 1.97% | 1.96% | 1.96% | 1.97% | 1.94% | 1.96% |
| pH | 10.00 | 10.00 | 10.33 | 10.33 | 10.67 | 10.67 | 11.00 | 11.00 |
| Color | | | | | | | | |
| Cielab L | 51.6 | 55.6 | 51.3 | 56.0 | 49.8 | 56.5 | 50.1 | 56.0 |
| Cielab a | 1.7 | 1.8 | 1.8 | 0.6 | 2.7 | −0.1 | 3.4 | 1.2 |
| Cielab B | −31.5 | −32.0 | −32.0 | −30.3 | −33.2 | −29.2 | −34.0 | −31.4 |

*On Weight Bath

188 OWB and 2% sodium borate are incorporated in the 4% caustic scouring bath. In each preparation, the sample is double dipped and double padded through its bleach bath for an 85% to 90% wet pickup. The sample is sealed in a type 5A Launder-ometer container and agitated in a 93 degree Celsius bath for 45 minutes. The bleached sample is boiled for 20 minutes each in two changes of 50 to 1 liquor to goods ratio boiling deionized water, padded to minimum wet pickup and then dried in a Kenmore dryer. The sample is steam-iron pressed and then allowed to equilibrate on the benchtop for one hour before being measured for Whiteness Index on the Hunterlab D25 colorimeter at six different points on the sample, taking L, a and b spectrum measurements. Data tabulated on the three samples in this experiment are shown in Table 5.

After the whiteness index is measured on each sample, an ultraviolet filter is used to remove the ultraviolet from the light source and the whiteness index is again measured. The difference between the whiteness indicies is tabulated as "whiteness differences".

TABLE 4

Study of whiteness index of 100% cotton army carded sateen treated with propychlorohydrin trimethylammonium chloride .15% $MgCl_2.6H_2O$, .25% EAA, .2% dodecylbenzenesulonic acid in a pH 10.8, 2% OWB hydrogen peroxide bleach bath containing Mobay Phorwhite 8A fabric brightener

| SAMPLE | 1 | 4 | 2 | 3 | 5 | 6 |
|---|---|---|---|---|---|---|
| Percent Wet pickup | 79.0% | 80.40% | 72.7% | 79.6% | 72.70% | 76.0% |
| Wt % Chptmac OWB in caustic scour | 0.0% | 1.0% | 0.0% | 0.0% | 1.0% | 1.0% |
| Wt % sodium borate OWB in caustic scour | 0.0% | 0.0% | 0.0% | 0.0% | 0.0% | 2.0% |
| Wt % Chptmac OWB in bleach bath | 0.0% | 1.0% | 0.0% | 1.0% | 0.0% | 0.0% |
| Wt % brightener OWB in bleach bath | 0.0% | 0.5% | 0.5% | 0.5% | 0.5% | 0.5% |
| Color | | | | | | |
| Cielab L | 96.0 | 95.6 | 96.0 | 96.2 | 95.8 | 96.0 |
| Cielab a | −0.4 | 3.6 | 3.3 | 3.5 | 3.7 | 3.9 |
| Cielab b | −0.2 | −6.8 | −7.4 | −7.6 | −8.1 | −8.4 |
| Whiteness Index | 90.7 | 128.2 | 133.0 | 135.2 | 136.4 | 139.0 |
| Whiteness Difference | 0.0 | 37.5 | 42.3 | 44.5 | 45.7 | 48.3 |

EXAMPLE 9

The following experiment was performed to illustrate that propylchlorohydrin trimethyl ammonium chloride can be incorporated into a hydrogen peroxide bleach bath for the purpose of improving the application of fiber reactive dye to the cellulosic fiber bleached and treated in the bath. In this experiment, enzyme desized and 4% OWB caustic scoured Testgabrics style 428R 100% cotton fabric samples are treated in a 1% hydrogen peroxide bath at a pH of 10.8 stabilized with 0.15% Mg $Cl_2$ $6H_2O$. 0.25% (solids basis), Primacor 5980® (Dow Adhesive Polymer Ethylene/Acrylic Acid Dispersion), 0.2% Triton non-ionic wetting agent, and 0.2% dodecylbenzenesulfonic acid. Each fabric samples measures approximately 8 inch by 1.5 inch. Caustic scouring is done to each sample by first padding 4% OWB (on weight bath) caustic, 0.25% sodium laurel sulfate on the fabric at an 85% wet pickup. The sample is then sealed in a type 2A launder-ometer container and held at 100 degrees for 30 minutes. The sample is then boiled in 800 mls. deionized water, padded to minimum wet pickup and left wet until bleaching is commenced. Fabric sample No. 1 is prepared in the unaltered bleach bath described above. Fabric sample No. 2 is treated in the original bleach bath additionally containing 0.5% OWB Dow Chemical Company Quat 188 propylchlorohydrin trimethyl ammonium chloride. Fabric sample No. 3 is treated in the above described bleach bath additionally containing 1.0% OWB epoxy compound. Fabric sample No. 4 is prepared like sample No. 2 with the exception that 0.6% epoxy compound in the caustic scouring bath. In each preparation, the sample is double dipped and double padded through its bleach bath for an 85% to 90% wet pickup. The sample is sealed in a type 5A Launder-ometer container and agitated in a 100 degree C. bath for 1 hour. The bleached sample is washed in 50 to 1 liquor to goods ratio boiling water followed with several rinses in cool deionized water. It is then padded to minimum wet pickup and dried in a Kenmore clothes dryer. The samples are then dyed using a Cotton Incorporated procedure shown in Table 7A. The composition of the dye bath incorporates 0.5% (On Weight Fabric) OWF Reactive Blue 52, 0.5 g/l anionic dispersant, 75 g/l common salt, 2 g/l sodium bicarbonate, and 4 g/l soda ash. 1.0 g/l nonionic soaping agent is used for soaping off the unfixed dye. After dyeing, all samples are dried in a Kenmore dryer, steam iron pressed, and then analyzed for color with a Hunterlab D25 colorimeter at six different points on the sample, taking L, a and b spectrum measurements.

EXAMPLE 10

The following experiment was performed to illustrate that propylchlorohydrin trimethyl ammonium chloride can be incorporated into a hydrogen peroxide bleach bath for the purpose of improving the application vat dye to the cellulosic fiber bleached and treated in the bath. In this experiment, enzyme desized and 4% OWB caustic scoured Testfabrics style 428R 100% cotton fabric samples are treated in a 1% hydrogen peroxide bath at a pH of 10.8 stabilized with 0.15% Mg $Cl_2$ $6H_2O$. 0.25% (solids basis), Primacor 5980® (Dow Adhesive Polymer Ethylene/Acrylic Acid Dispersion), 0.2% Triton non-ionic wetting agent, and 0.2% dodecylbenzenesulfonic acid, and 8 ppm ferric chloride to challenge the stabilizer system. Each fabric samples measures approximately 8 inch by 1.5 inch. Caustic scouring is done to each sample by first padding 4% OWB (on weight bath) caustic, 0.25% sodium laurel sulfate on the fabric at an 85% wet pickup. The sample is then sealed in a type 2A launderometer container and held at 100 degrees for 30 minutes. The sample is then boiled in 800 mls. deionized water, padded to minimum wet pickup and left wet until bleaching is commenced. Fabric sample No. 1 is prepared in the unaltered bleach bath described above. Fabric sample No. 2 is treated in the original bleach bath additionally containing 0.5% OWB Dow Chemical Company Quat 188 propylchlorohydrin trimethyl ammonium chloride. Fabric sample No. 3 is treated in the above described bleach bath additionally containing 1.0% OWB epoxy compound. Fabric sample No. 4 is prepared like sample No. 2 with the exception that 0.6% epoxy compound in the caustic scouring bath. In each preparation, the sample is double dipped and double padded through its bleach bath for an 85% to 90% wet pickup. The sample is sealed in a type 5A Launder-ometer container and agitated in a 100 degree C. bath for 1 hour. The bleached sample is washed in 50 to liquor to goods ratio boiling water followed with several rinses in cool deionized water. It is then padded to minimum wet pickup and dried in a Kenmore clothes dryer. The samples are then dyed using a Cotton Incorporated procedure modified slightly for Launder-ometer use. The composition of the dye bath incorporates 0.5% g/l nonionic detergent. After dyeing, all samples are dried in a Kenmore dryer, steam iron pressed, and then analyzed for color with a Hunterlab D25 colorimeter a six different points on the sample, taking L, a and b spectrum measurements.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A process for improving the whiteness of a cellulosic fabric which comprises the steps of:

A. scouring said fabric in an aqueous sodium hydroxide solution so as to remove natural fats and oils;

B. treating said fabric from step A with steam;

C. removing excess sodium hydroxide solution from said fabric; and then,

D. treating said fabric with an aqueous solution with an epoxy compound of the formula:

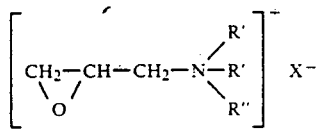

where R, R' and R'' are each lower alkyl radicals and X is an anion whereby the whiteness of said fabric is improved.

2. The process of claim 1 in which said fabric after step A is treated with a solution containing sodium sulfate.

3. The process of claim 2 wherein said sodium sulfate is included in the aqueous solution comprising epoxy trimethylpropyl ammonium chloride of step D.

4. A process for improving the whiteness of a cellulosic fabric and improving its receptivity to anionic dyes which comprises the steps of:

A. scouring said fabric in an aqueous sodium hydroxide solution so as to remove natural fats and oils;

B. treating said fabric from step A with steam;

C. removing excess sodium hydroxide solution from said fabric; and then,

D. treating said fabric with a bleaching solution containing epoxypropyl trimethylammonium chloride, whereby the whiteness of said fabric is improved.

5. The process of claim 4 wherein said bleaching solution of step D comprises hydrogen peroxide.

6. The process of claim 4 wherein said bleaching solution of step D comprises sodium hypochlorite.

7. The process of claim 4 wherein said fabric is subsequently treated with sodium sulfate.

8. The process of claim 4 wherein said bleaching solution contains sodium sulfate.

9. The process of claim 4 wherein said fabric is a yarn, tow, batting or cloth.

* * * * *